US009976398B2

(12) United States Patent
Paulet et al.

(10) Patent No.: US 9,976,398 B2
(45) Date of Patent: May 22, 2018

(54) SENSING IN ARTIFICIAL LIFT SYSTEMS

(71) Applicant: Weatherford Technology Holdings, LLC, Houston, TX (US)

(72) Inventors: Bryan A. Paulet, Spring, TX (US); Manish Agarwal, Cypress, TX (US); Paul M. Lachin, Katy, TX (US); Ross E. Moffett, Kingwood, TX (US); Stephen E. Cannon, Canton, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 867 days.

(21) Appl. No.: 14/250,196

(22) Filed: Apr. 10, 2014

(65) Prior Publication Data

US 2014/0305636 A1 Oct. 16, 2014

Related U.S. Application Data

(60) Provisional application No. 61/811,558, filed on Apr. 12, 2013.

(51) Int. Cl.

| | |
|---|---|
| ***E21B 44/00*** | (2006.01) |
| ***E21B 43/12*** | (2006.01) |
| ***E21B 43/08*** | (2006.01) |
| ***E21B 47/00*** | (2012.01) |

(52) U.S. Cl.

CPC ..... *E21B 43/121* (2013.01); *E21B 43/082* (2013.01); *E21B 47/0007* (2013.01)

(58) Field of Classification Search

CPC ..... E21B 47/007; E21B 43/121; E21B 43/082
See application file for complete search history.

(56) References Cited

U.S. PATENT DOCUMENTS

| | | | | |
|---|---|---|---|---|
| 5,252,031 | A | 10/1993 | Gibbs | |
| 5,826,659 | A * | 10/1998 | Hershberger | E21B 43/12 166/372 |
| 5,984,013 | A | 11/1999 | Giacomino et al. | |
| 6,241,014 | B1 | 6/2001 | Majek et al. | |
| 6,634,426 | B2 | 10/2003 | McCoy et al. | |
| 6,883,606 | B2 | 4/2005 | Evans et al. | |

(Continued)

FOREIGN PATENT DOCUMENTS

CA 2764651 A1 7/2012

OTHER PUBLICATIONS

Canadian Office Action dated Mar. 3, 2016, corresponding to Application No. 2,848,865.

*Primary Examiner* — Nicole Coy
(74) *Attorney, Agent, or Firm* — Patterson & Sheridan, L.L.P.

(57) ABSTRACT

Methods and apparatus are provided for measuring one or more parameters associated with an artificial lift system for hydrocarbon production and operating the system based on the measured parameters. One embodiment of the invention provides a lubricator for a plunger lift system, which generally includes a housing, a spring disposed in the housing for absorbing an impact by a plunger, and a sensor configured to measure at least one parameter of the spring. One example method of operating a plunger lift system for hydrocarbon production generally includes measuring at least one parameter of a spring disposed in a lubricator of the plunger lift system and operating the plunger lift system based on the measured parameter.

47 Claims, 7 Drawing Sheets

(56) References Cited

U.S. PATENT DOCUMENTS

| | | | | |
|---|---|---|---|---|
| 7,219,725 | B2 | 5/2007 | Chisholm | |
| 7,273,098 | B2 | 9/2007 | Evans et al. | |
| 7,571,643 | B2 * | 8/2009 | Sugiura | E21B 7/062 73/152.46 |
| 7,591,308 | B2 | 9/2009 | Bender | |
| 7,681,641 | B2 | 3/2010 | Mudry | |
| 7,963,326 | B2 | 6/2011 | Giacomino | |
| 9,181,768 | B2 * | 11/2015 | Wright | E21B 23/00 |
| 2012/0193091 | A1 | 8/2012 | Bender et al. | |
| 2015/0130627 | A1 * | 5/2015 | Morrison | E21B 44/00 340/854.4 |

* cited by examiner

SENSING IN ARTIFICIAL LIFT SYSTEMS

CLAIM OF PRIORITY UNDER 35 U.S.C. § 119

This application claims benefit of U.S. Provisional Patent Application Ser. No. 61/811,558, filed Apr. 12, 2013 and entitled "Sensing in Artificial Lift Systems," which is herein incorporated by reference in its entirety.

BACKGROUND OF THE INVENTION

Field of the Invention

Embodiments of the present invention generally relate to hydrocarbon production using artificial lift and, more particularly, to operating an artificial lift system based on measurements of one or more sensed parameters associated with the system.

Description of the Related Art

Several artificial lift techniques are currently available to initiate and/or increase hydrocarbon production from drilled wells. These artificial lift techniques include rod pumping, plunger lift, gas lift, hydraulic lift, progressing cavity pumping, and electric submersible pumping, for example. Unlike most artificial lift techniques, plunger lift operates without assistance from external energy sources.

U.S. Pat. No. 6,634,426 to McCoy et al., entitled "Determination of Plunger Location and Well Performance Parameters in a Borehole Plunger Lift System" and issued Oct. 21, 2003, describes monitoring acoustic signals in the production tubing at the surface to determine depth of a plunger based on sound made as the plunger passes by a tubing collar recess. However, this application based on monitoring acoustic signals at the surface of a plunger lift system is somewhat limited.

SUMMARY OF THE INVENTION

Embodiments of the present invention generally relate to measuring one or more parameters associated with an artificial lift system and taking a course of action or otherwise operating the system based on the measured parameters.

One embodiment of the present invention is a lubricator for a plunger lift system for hydrocarbon production. The lubricator generally includes a housing, a spring disposed in the housing for absorbing an impact by a plunger, and a sensor configured to measure at least one parameter of the spring.

Another embodiment of the present invention is a method of operating a plunger lift system for hydrocarbon production. The method generally includes measuring at least one parameter of a spring disposed in a lubricator of the plunger lift system and at least one of: operating the plunger lift system based on the measured parameter or storing the measured parameter in a memory.

Yet another embodiment of the present invention is a method of operating an artificial lift system for hydrocarbon production. The method generally includes measuring at least one parameter during at least a portion of a cycle in the artificial lift system, determining a signature for the at least the portion of the cycle, based on the measured parameter, and comparing the signature to a plurality of predetermined signatures.

Yet another embodiment of the present invention is a method of operating an artificial lift system for hydrocarbon production. The method generally includes measuring at least one parameter of the artificial lift system using at least one of an accelerometer or a microelectromechanical systems (MEMS)-based sensor and operating the artificial lift system based on the measured parameter.

Yet another embodiment of the present invention provides a control unit for a plunger lift system for hydrocarbon production. The control unit is generally configured to receive at least one measured parameter of a spring disposed in a lubricator of the plunger lift system and to output at least one signal for operating the plunger lift system based on the measured parameter.

Yet another embodiment of the present invention provides a control unit for an artificial lift system for hydrocarbon production. The control unit is generally configured to receive at least one measured parameter during at least a portion of a cycle in the artificial lift system; to determine a signature for the at least the portion of the cycle, based on the measured parameter; and to compare the signature to a plurality of predetermined signatures.

Yet another embodiment of the present invention provides a control unit for an artificial lift system for hydrocarbon production. The control unit is generally configured to receive at least one parameter of the artificial lift system measured using at least one of an accelerometer, a strain gauge, or a microelectromechanical systems (MEMS)-based sensor and to output a signal for operating the artificial lift system based on the measured parameter.

Yet another embodiment of the present invention provides a computer-readable medium containing a program which, when executed by a processor, performs operations for operating a plunger lift system for hydrocarbon production. The operations generally include measuring at least one parameter of a spring disposed in a lubricator of the plunger lift system and operating the plunger lift system based on the measured parameter.

Yet another embodiment of the present invention provides a computer-readable medium containing a program which, when executed by a processor, performs operations for operating an artificial lift system for hydrocarbon production. The operations generally include measuring at least one parameter during at least a portion of a cycle in the artificial lift system, determining a signature for the at least the portion of the cycle, based on the measured parameter, and comparing the signature to a plurality of predetermined signatures.

Yet another embodiment of the present invention provides a computer-readable medium containing a program which, when executed by a processor, performs operations for operating an artificial lift system for hydrocarbon production. The operations generally include measuring at least one parameter of the artificial lift system using at least one of an accelerometer, a strain gauge, or a MEMS-based sensor and operating the artificial lift system based on the measured parameter.

BRIEF DESCRIPTION OF THE DRAWINGS

So that the manner in which the above-recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Embodiments of the present invention provide techniques and apparatus for measuring one or more parameters associated with an artificial lift system for hydrocarbon production and operating the system based on the measured parameters.

Example Artificial Lift System

Figure 1:
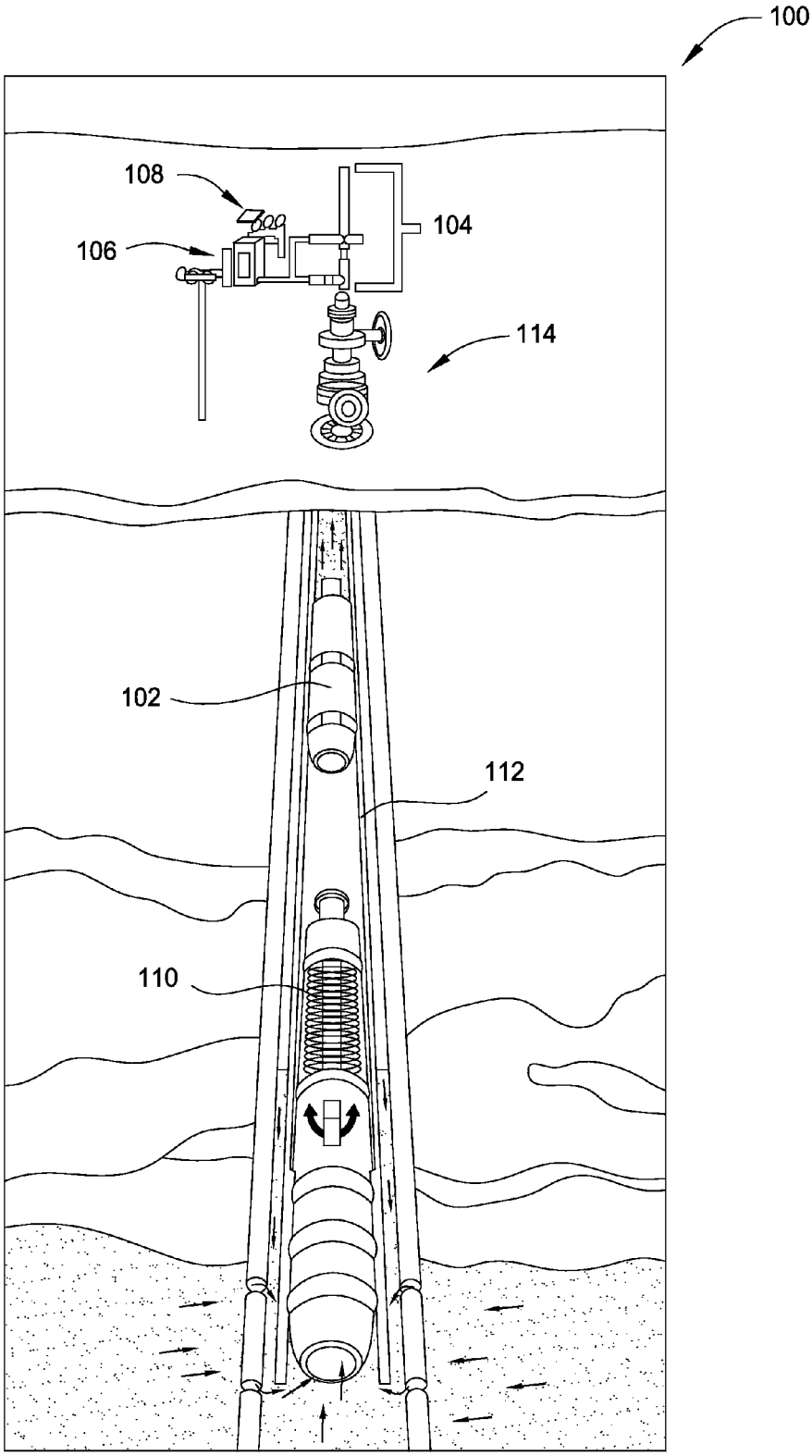
FIG. 1 is a schematic depiction of an example plunger lift system, in accordance with embodiments of the invention.

As described above, one type of artificial lift system is a plunger lift system. FIG. 1 is a schematic depiction of an example plunger lift system 100, in accordance with embodiments of the invention. The plunger lift system 100 may include a plunger 102 (often referred to as a piston), two bumper springs 110, 202, a lubricator 104 to sense and stop the plunger 102 as it arrives at the surface, and a surface controller 106 of which several types are available. Various ancillary and accessory components are used to complement and support various applications of the plunger lift system 100. For example, the surface controller 106 may be powered by an energy source 108, such as a solar panel as illustrated in FIG. 1.

Figure 2A:
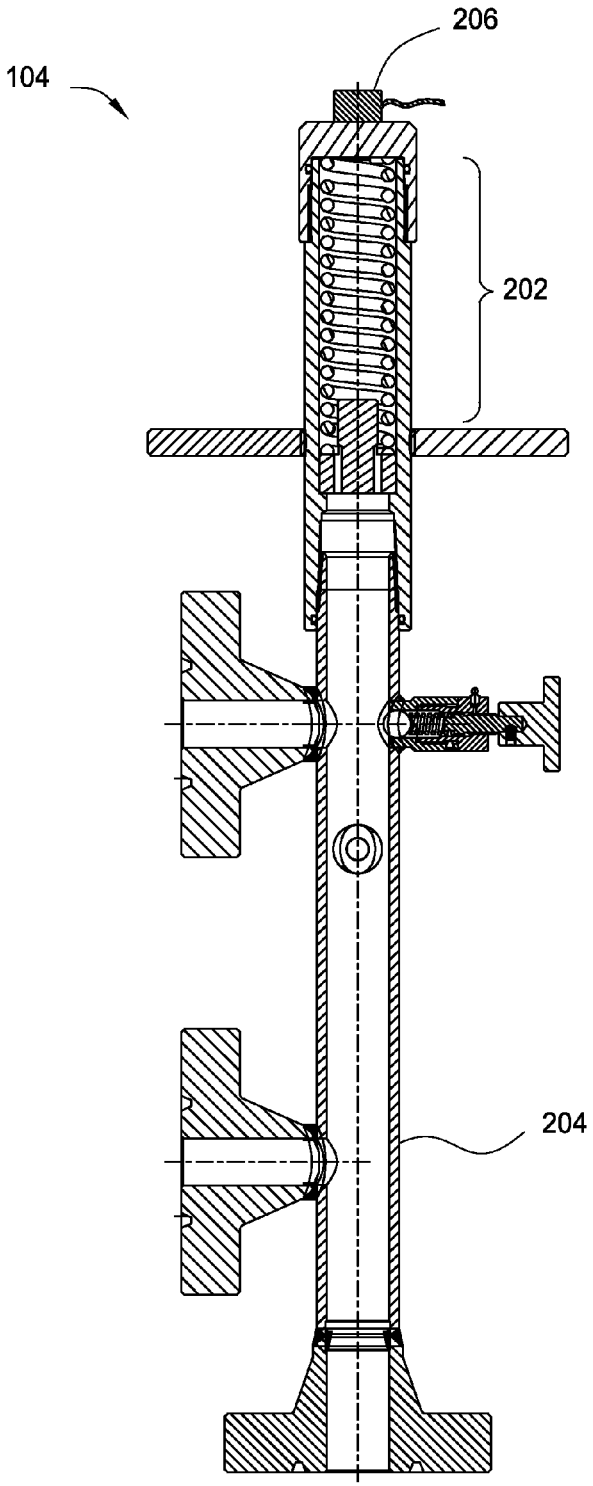
FIGS. 2A-2C are schematic depictions of example lubricators with sensors, in accordance with embodiments of the invention.
Figure 2B:
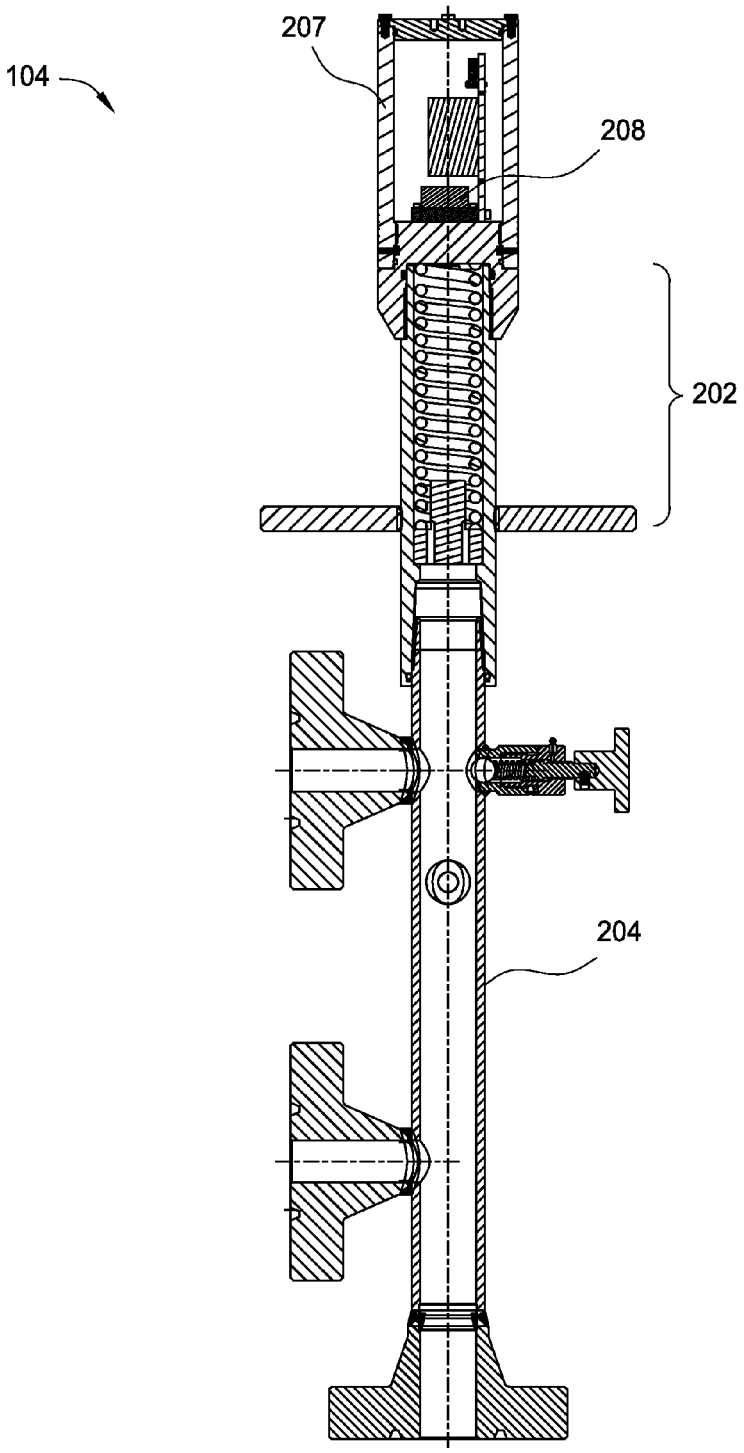

In a typical plunger lift operation, the plunger 102 cycles between the lower bumper spring 110 located in the bottom section of the production tubing string 112 and the upper bumper spring 202 located in the surface lubricator 104 on top of the wellhead 114. The lower bumper spring 110 may also be known as simply "the bumper spring," while the upper bumper spring 202 may also be referred to as "the lubricator spring" and is illustrated in FIG. 2A. In some applications, the lower bumper spring 110 is placed above a gas lift mandrel. As the plunger 102 travels to the surface, the plunger creates a solid interface between the lifted gas below and the produced fluid above to maximize lifting energy.

The plunger 102 travels from the bottom of the well (or another point located downhole) to the surface lubricator 104 on the wellhead 114 when the force of the lifting gas energy below the plunger is greater than the cumulative weight of the plunger and the liquid load above the plunger, as well as the force to overcome static line pressure and friction loss of the fluid and plunger traveling to the surface. Any gas that bypasses the plunger 102 during the lifting cycle flows up the production tubing 112 and sweeps the area to minimize liquid fallback. The incrementation of the travel cycle is controlled by the surface controller 106 and may be repeated as often as desired.

Example Lubricator Spring Sensor

One of the most common problems with the lubricator 104 occurs due to forceful impacts on the upper bumper spring 202 by the plunger 102. After repetitive plunger impacts, the upper bumper spring 202 may begin to deteriorate and may eventually fail, such that the spring's ability to absorb energy is gone, or at least drastically reduced. Once spring failure occurs, the entire impact force of the plunger 102 is transferred to the body 204 (i.e., the housing) of the lubricator 104, often resulting in mechanical damage to the plunger and/or lubricator. Such damage may even lead to failure of the plunger lift system.

Accordingly, what is needed are techniques and apparatus to monitor the condition of the upper bumper spring 202 in the lubricator 102 in an operating plunger lift system 100.

Embodiments of the present invention provide methods and apparatus for monitoring the physical condition of the upper bumper spring 202. The spring's health may be monitored by sensing the installed spring force with the use of a sensor 206. For some embodiments as illustrated in FIG. 2A, the sensor 206 may be mechanically coupled to the upper bumper spring 202 on top of the lubricator 104 and may function as a lubricator spring sensor. For example, sensing the installed spring force may be accomplished by using a load cell 208 (e.g., a strain gauge) or any other suitable transducer that converts force into an electrical signal. Disposed in a housing 207 adjacent the upper bumper spring 202 at the top of the lubricator 104, the load cell 208 may measure the installed spring load in real time. The measured spring load may be sent (e.g., via an electrical or optical cable or wirelessly) to the surface controller 106 and/or another processing unit for storage, analysis, monitoring, and/or display on a screen.

Figure 2C:
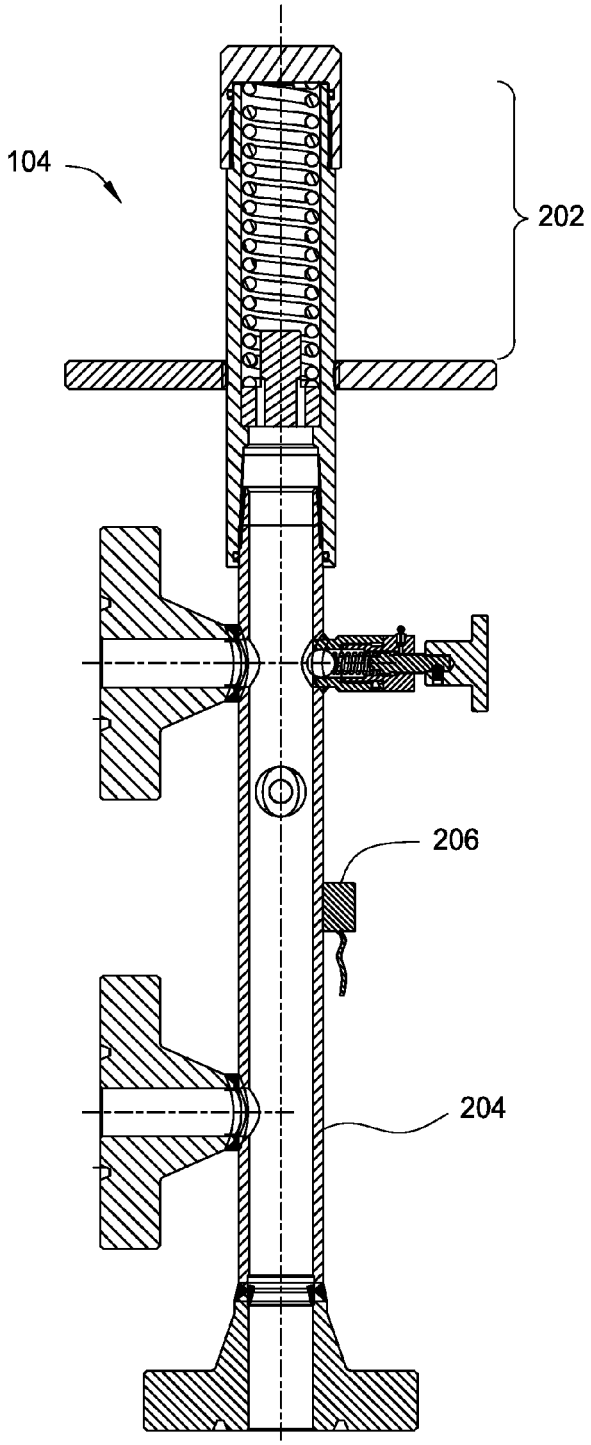

For other embodiments as depicted in FIG. 2C, the sensor 206 may be mechanically coupled to the body 204 (including the housing for the upper bumper spring 202) of the lubricator 104. For example, the sensor 206 may be attached to the body 204 with an (adjustable) strap or a clamp. The strap or clamp may be configured to mount on one or more lubricators offered by Weatherford/Lamb, Inc. of Houston, Tex., as well as on one or more competitors' lubricators.

For some embodiments, an operator may monitor the sensed load on the screen, or the processing unit may send data or alerts to the operator via a wired or wireless network. After repetitive usage, if the spring load measured by the load cell 208 drops below a predetermined threshold level, the operator may make note of the reduced spring load, or the processing unit may alert the operator to the reduced spring load, via an auditory and/or visual alarm or a message (e.g., displayed on the screen or transmitted via wired or wireless communication techniques). In this manner, the upper bumper spring 202 may be replaced before the spring actually fails and before the lubricator 104 is damaged.

Other Example Artificial Lift Sensors and Sensed Parameters

An artificial lift system may include alternative or additional sensors to the lubricator spring sensor (e.g., the load cell 208). For example, an artificial lift system may include one or more accelerometers along one or more axes, which may be used to detect and monitor vibration of various components within the system or to measure shock. For example, in the plunger lift system 100, an accelerometer may be used to measure the force of the plunger 102 impacting the upper bumper spring 202. In this case, the sensor 206 may be installed on a cap of the lubricator 104 as shown in FIG. 2A. As another example, an artificial lift system may include one or more microphones for picking up sound waves. For example, these sound waves may be caused by vibrations induced in the production tubing metal and may travel to the microphone via the tubing for transduction to electrical signals. For some embodiments, the sensors 206 (e.g., the accelerometers or the microphones) may be microelectromechanical systems (MEMS)-based sensors, which are typically smaller, cheaper, and/or less intrusive than most types of conventional sensors.

Figure 3:
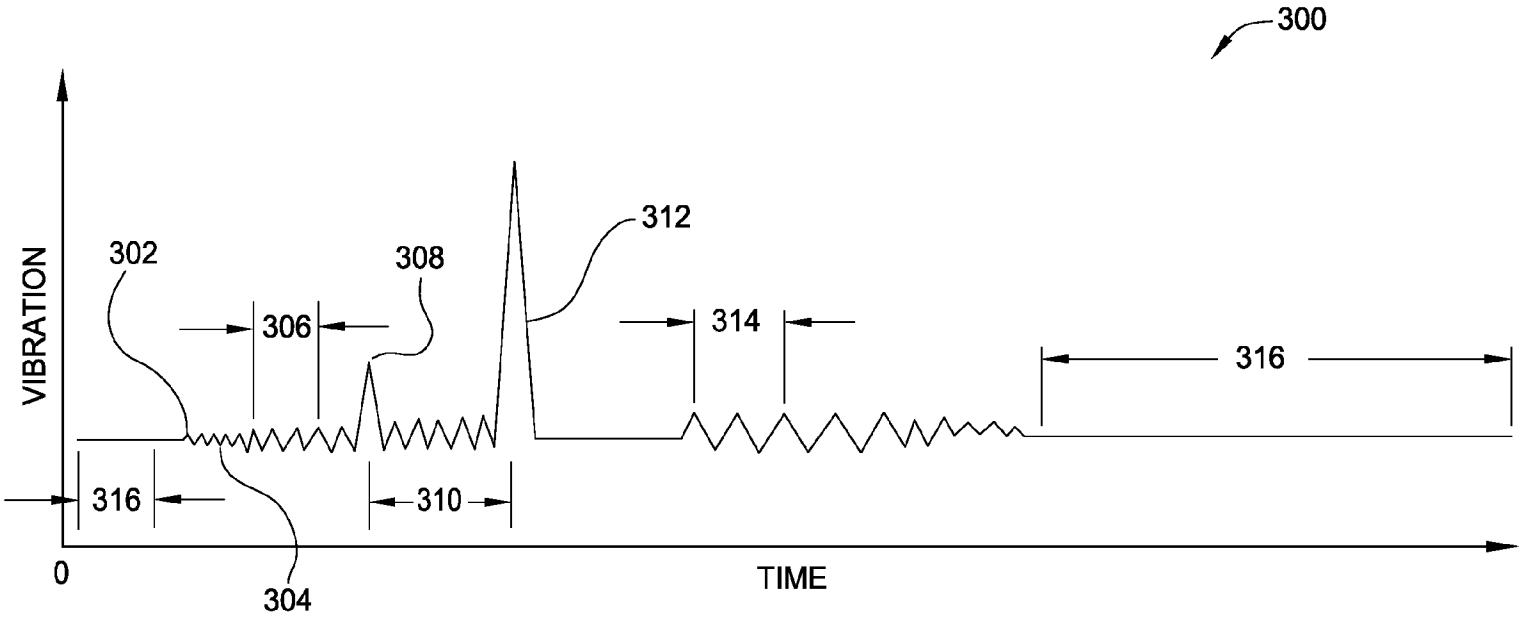
FIG. 3 is an example graph of measured vibration versus time, in accordance with embodiments of the invention.

FIG. 3 is an example graph 300 of measured vibration versus time, illustrating various data scenarios in an artificial lift system (e.g., the plunger lift system 100), in accordance with embodiments of the invention. Although only vibration is shown in the graph 300, sound waves sensed by a microphone may produce a graph similar in appearance. Furthermore, certain data scenarios depicted in the graph 300 will appear in other types of artificial lift systems besides the plunger lift system described.

In the graph 300, a normally flowing well may have a steady state vibration as indicated at 302. At 304, the vibration signal may indicate that an object (e.g., the plunger 102) is moving in the production tubing 112. In the alternative, the amplitude of the signal at 304 may also indicate that a component at the top of the artificial lift assembly (e.g., the upper bumper spring 202 in the lubricator 104) has lost compression and is vibrating.

The vibration peaks in the interval 306 may be the signature when the moving object (e.g., the plunger 102) crosses the coupler interface (i.e., the connection between the tubing joints). Based on the known spacing between couplings (i.e., the length of a tubing joint) and the time between the vibration peaks, the rise or lift velocity of the moving object may be calculated.

At 308, the vibration signature in the graph 300 indicates the fluid hammer effect of the fluid interface hitting the top of the artificial lift assembly (e.g., the lubricator 104). At 312, the largest vibration peak indicates the mechanical impact of the moving object impacting the top of the assembly (e.g., the plunger 102 impacting the upper bumper spring 202). By knowing the tubing geometry (e.g., cross-sectional area), the interval 310 between the peak at 308 and the peak at 312 may be used to calculate the fluid volume produced during this artificial lift cycle. The interval 310 (or the calculated fluid volume) may also indicate a dry run, in which the fluid volume is relatively low, or even zero.

For some embodiments, the amplitude of the peak at 312 may be used to derive the plunger velocity, since force equals mass multiplied with acceleration (F=ma) and the plunger mass may be predetermined. The vibration peak at 312 may also provide for calculating wear on a component at the top of the artificial lift assembly (e.g., the spring 202). The component wear (e.g., the spring wear) may be based on a ratio of the calculated fluid volume to the peak force (i.e., the amplitude of the vibration peak at 312). Because the moving object (e.g., the plunger 102) moves with a higher velocity during dry runs and a higher velocity leads to a greater impact on the spring 202, the amplitude of the vibration peak at 312 may be used to indicate a dry run. Furthermore, the height of the vibration peak at 312 may indicate an undersized component (e.g., a spring 202 that is not strong enough to absorb the impact of the plunger 102).

For some embodiments, the vibration (or acoustic) signature may be used to determine slugging behavior of the fluid following arrival of the plunger at the top of the assembly (i.e., after the peak at 312).

The vibration peaks in the interval 314 may be the signature when the moving object (e.g., the plunger 102) crosses the coupler interface (i.e., the connection between the tubing joints) when moving from the top of the artificial lift assembly to the bottom of the assembly (e.g., from the upper bumper spring 202 to the lower bumper spring 110). Based on the known spacing between couplings (i.e., the length of a tubing joint) and the time between the vibration peaks, the fall velocity of the moving object may be calculated.

An increase in the vibration (or noise if detecting sound) levels as measured at the top of the artificial lift assembly (e.g., in the lubricator 114) between the periods at 316 may indicate that a component (e.g., the spring 202) is moving during the gas flow period. In the case of a plunger lift system, this movement may indicate spring wear or loss or a reduction of the spring preload.

The data scenarios illustrated in the graph 300 have several control and monitoring implications. Based on the velocity determinations, control parameters (e.g., time or pressure buildup) may be adjusted. For example, the well control parameters (e.g., a valve opening) may be adjusted to slow the arrival of the moving object (e.g., the plunger 202) and reduce the force of the impact with the top of the artificial lift assembly (e.g., the upper bumper spring 202). In the case of a plunger, for example, a valve may be throttled to slow the plunger, especially in the case of continuous flow plungers. For some embodiments, if the velocity is too high (e.g., above a threshold value) the well may be shut in to protect well equipment. Similarly, well control parameters may be adjusted based on detecting that the moving object did not impact the top of the assembly (e.g., the plunger 102 did not impact the spring 202 (i.e., non-arrival of the plunger)).

An operator may manage fluid production based on the calculated fluid volume. For example, the moving object or the pumping rate may be slowed down by adjusting the well control parameters based on detection of a low fluid volume or a dry run.

For some embodiments, the well control parameters may be adjusted if the shock on arrival (e.g., the amplitude of the peak at 312) is too high (e.g., above a threshold value) or indicates a dry run. As described above, the shock may also be used to calculate the fluid volume produced. This fluid volume may be used to determine efficiency of certain components (e.g., the upper bumper spring 202) for some embodiments. If the shock is excessive or breakage of components (e.g., the spring) is detected, the well may be shut in.

For some embodiments, by knowing the position of the plunger 102, the downhole fluid level may be inferred based on ping echoes from the plunger. The well control parameters may be adjusted based on the downhole fluid level.

Analysis in the frequency domain (e.g., based on a fast Fourier transform (FFT) of the time-domain signals may lead to other determinations and adjustments of the well control parameters.

Operating an Artificial Lift System

Figure 4:
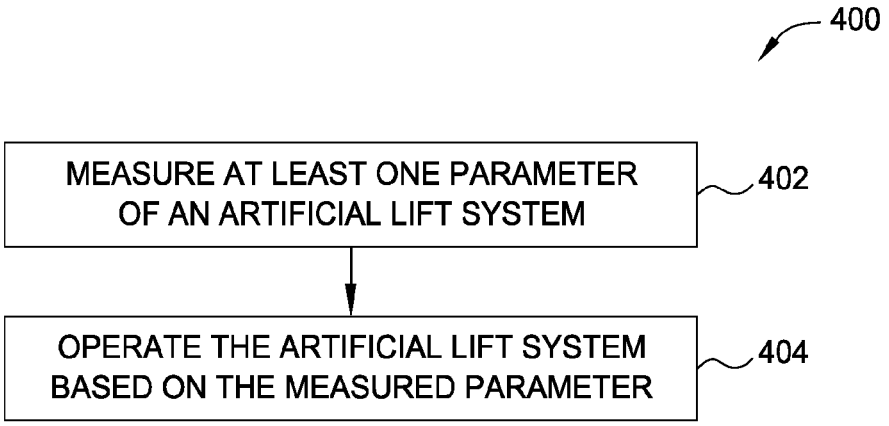
FIG. 4 is a flow diagram of example operations for operating an artificial lift system, in accordance with embodiments of the invention.

FIG. 4 is a flow diagram of example operations 400 for operating an artificial lift system for hydrocarbon production, in accordance with embodiments of the invention. For example, the artificial lift system may be a rod pumping system, a plunger lift system, a gas lift system, a hydraulic lift system, a progressing cavity pumping system, an electric submersible pumping system, or any suitable pumping system for hydrocarbon production. The operations 400 may be performed by a control unit, such as the surface controller 106.

The operations 400 may begin, at 402, by measuring at least one parameter of an artificial lift system. The parameter may be measured using a sensor, such as at least one of an accelerometer, a strain gauge, or a microelectromechanical systems (MEMS)-based sensor. For some embodiments, the accelerometer is a MEMS-based accelerometer. The MEMS-based sensor may be a MEMS-based microphone, for example. For some embodiments, the operations may further include displaying the measured parameter on a computer monitor or other display and/or storing the measured parameter in a memory.

At 404, the artificial lift system may be operated based on the measured parameter. For some embodiments, operating the artificial lift system includes replacing a component (e.g., a bearing or valve) in the system that is worn, damaged, incorrectly sized, or functioning improperly, for example, based on the measured parameter. Operating the artificial lift system may also include adjusting control settings (e.g., valve control) of the artificial lift system based on the measured parameter.

For some embodiments, the operations 400 may include storing the measured parameter(s) of the artificial lift system in a memory (e.g., a memory associated with the control unit) instead of or in addition to operating the system at 404. In this manner, lift system parameter(s) may be captured and logged in an effort, for example, to analyze and compare performance of the lift cycles over time. This study may be performed to learn more about long-term behavior of the system. For some embodiments, the artificial lift system may then be operated based on this analysis (e.g., by replacing or repairing a system component, adjusting a control variable, etc.).

The artificial lift system may include production tubing 112 composed of multiple tubing joints connected together. For some embodiments, the at least one parameter is a vibration or sound of a fluid or an object associated with the artificial lift system moving across interfaces between the tubing joints. In this case, the operations 400 may further include determining at least one of a rising velocity or a falling velocity of the fluid or the object based on the vibration or sound, and operating the artificial lift system at 404 may include adjusting control settings of the artificial lift system based on the rising velocity or the falling velocity.

According to some embodiments, the at least one parameter includes a vibration or sound of a fluid or an object associated with the artificial lift system. The vibration or sound of the fluid or the object may indicate wear or declining performance of a component in the artificial lift system. For some embodiments, the operations 400 may further include calculating a fluid volume based on a predetermined production tubing geometry and the vibration or sound of the fluid or the object.

In gas lift systems, for example, measuring at least one parameter at 402 may involve detecting the performance of a downhole gas lift valve. Such performance may include an indication of proper operation, a change in operation (e.g., a cut valve), an indication of valve failure (e.g., a clogged valve), and the like. The change in operation may be determined based on a comparison with a parameter stored initially, over time, or during a known good operating cycle, for example.

In a rod pumping system, for example, measuring at least one parameter at 402 may involve detecting the performance of a surface pumping unit and associated equipment. Such performance may include an indication of proper operation, a change in operation (e.g., worn bearings), an indication of surface or sub-surface component failure (e.g., parted rods), and the like. The change in operation may be determined based on a comparison with a parameter stored initially, over time, or during a known good operating cycle, for example.

Figure 5:
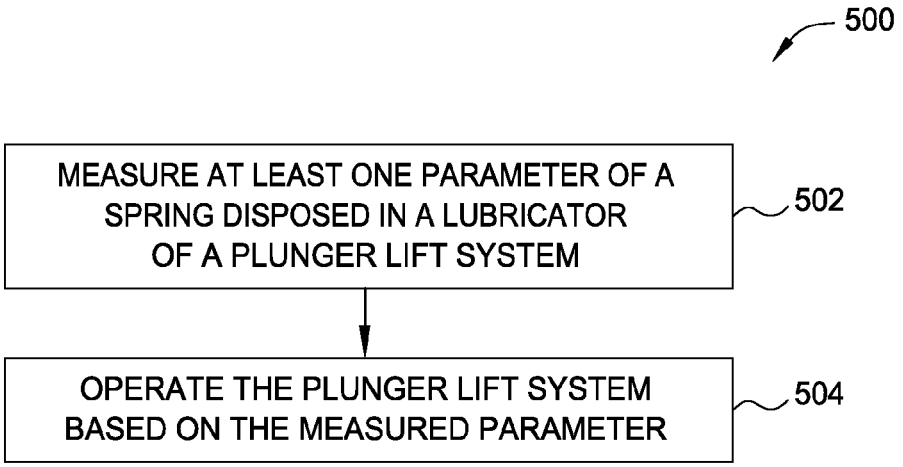
FIG. 5 is a flow diagram of example operations for operating a plunger lift system, in accordance with embodiments of the invention.

FIG. 5 is a flow diagram of example operations 500 for operating a plunger lift system 100 for the production of hydrocarbons, in accordance with embodiments of the invention. The operations 500 may be performed by a control unit, such as the surface controller 106. The operations 500 may begin, at 502, by measuring at least one parameter of a spring (e.g., the upper bumper spring 202) disposed in a lubricator 104 of the plunger lift system 100. For some embodiments, the measured parameter may be output to a display.

At 504, the plunger lift system 100 may be operated based on the measured parameter. For some embodiments, operating the plunger lift system includes replacing the spring or another component in the system that is worn, damaged, or incorrectly sized, for example, based on the measured parameter. Operating the plunger lift system may also include adjusting control settings (e.g., valve control) of the plunger lift system based on the measured parameter. For example, one or more valves in the lubricator 104 and/or the wellhead 114 may be controlled to adjust the speed of the moving plunger 102.

For some embodiments, the operations 500 may include storing the measured parameter(s) of the plunger lift system in a memory instead of or in addition to operating the system at 504. In this manner, repeatedly measured plunger lift system parameter(s) may be captured and logged in an effort, for example, to analyze and compare performance of the plunger lift cycles over time. For some embodiments, the plunger lift system may then be operated based on this analysis (e.g., by replacing or repairing a system component, adjusting a system control setting, etc.).

According to some embodiments, the at least one parameter includes a spring preload. In this case, operating the plunger lift system at 504 may include determining that the spring preload is below a threshold level. The spring may be replaced based on this determination.

According to some embodiments, the at least one parameter includes at least one of a force of the impact by the plunger, vibration of the spring, or sound waves produced by the spring. These sound waves may travel to the sensor via the housing of the lubricator 104 and/or liquid contained therein. For some embodiments, operating the plunger lift system may include determining that the spring has lost compression based on the vibration. The spring may be replaced based on this determination.

According to some embodiments, the operations 500 may further include determining a first time when a fluid interface contacts the lubricator based on the at least one parameter; determining a second time when the plunger impacts the lubricator based on the at least one parameter; and calculating a fluid volume based on a predetermined production tubing geometry and a difference between the first and second times. In this case, operating the plunger system at 504 may include adjusting control settings of the plunger lift system based on the calculated fluid volume. The calculated fluid volume may indicate a dry run for a cycle of the plunger lift system. For some embodiments, the operations 500 may further include calculating wear of the spring based on a ratio of the calculated fluid volume to the force of the impact by the plunger.

Operation cycles of a plunger lift or other artificial lift system may have a certain signature, which offers a visual representation of the operating characteristics of the system for a particular cycle or portion thereof. For some embodiments, this signature may be similar to a downhole pump card for rod pumping as disclosed in U.S. Pat. No. 5,252,031 to Gibbs, entitled "Monitoring and Pump-Off Control with Downhole Pump Cards" and issued Oct. 12, 1993, for example. Gibbs teaches a method for monitoring a rod-pumped well to detect various pump problems by utilizing measurements made at the surface to generate a downhole pump card. The shape of the graphically represented downhole pump card may then be used to detect the various pump problems and control the pumping unit. Likewise, the signature of at least a portion of the operation cycle for a plunger lift or other artificial lift system may be compared to a database of stored signatures illustrating various operating characteristics and/or failure modes of the system. Based on this comparison, an operating characteristic or failure mode of the currently operating system may be detected.

Figure 6:
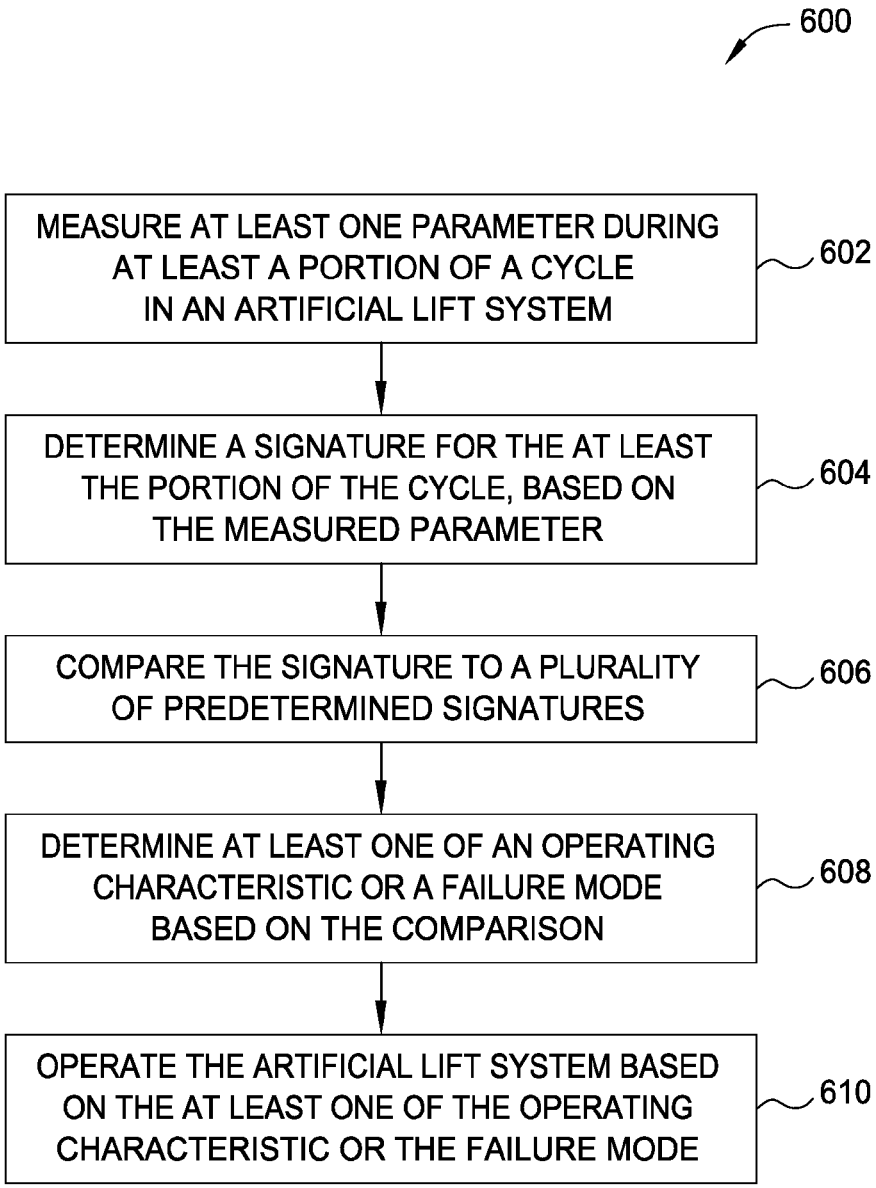
FIG. 6 is a flow diagram of example operations for operating an artificial lift system based on a comparison of a measured signature to predetermined signatures, in accordance with embodiments of the invention.

FIG. 6 is a flow diagram of example operations 600 for operating an artificial lift system for hydrocarbon production, in accordance with embodiments of the invention. For example, the artificial lift system may be a rod pumping system, a plunger lift system, a gas lift system, a hydraulic lift system, a progressing cavity pumping system, an electric submersible pumping system, or any suitable pumping system for hydrocarbon production. The operations 600 may be performed by a control unit, such as the surface controller 106.

The operations 600 may begin, at 602, by measuring at least one parameter during at least a portion of a cycle in the artificial lift system. The at least one parameter may include sound, vibration, or shock, for example. The at least one parameter may be measured by at least one sensor located at or adjacent a wellhead 114 (e.g., in or coupled to a lubricator 104), and the control unit may receive these measurements.

According to some embodiments, the at least one parameter is measured using a microelectromechanical systems (MEMS) device. For some embodiments, the MEMS device may be an accelerometer or a microphone.

At 604, a signature for the at least the portion of the cycle may be determined, based on the measured parameter. For some embodiments, the operations 600 may further include outputting a visual representation of the signature to a display. At 606, the signature may be compared to a plurality of predetermined signatures. For example, one of the predetermined signatures may be for a known-good operating cycle of the artificial lift system.

The operations 600 may further include determining at least one of an operating characteristic, a downhole event, or a failure mode at 608, based on the comparison at 606. At 610, the artificial lift system may be operated based on the at least one of the operating characteristic or the failure mode. For some embodiments, the failure mode may be at least one of a damaged spring, loss of spring preload, a clogged valve, or a worn spring or bearing. The operating characteristic may include at least one of a dry run, a lift velocity, or a fall velocity, for example. The operating characteristic may also include a change (e.g., a change in the pumping geometry) over time, which may indicate a precursor to a failure mode.

Any of the operations described above, such as the operations 400, may be included as instructions in a computer-readable medium for execution by the surface controller 106 or any suitable processing system. The computer-readable medium may comprise any suitable memory or other storage device for storing instructions, such as read-only memory (ROM), random access memory (RAM), flash memory, an electrically erasable programmable ROM (EEPROM), a compact disc ROM (CD-ROM), or a floppy disk.

While the foregoing is directed to embodiments of the present invention, other and further embodiments of the invention may be devised without departing from the basic scope thereof, and the scope thereof is determined by the claims that follow.

The invention claimed is:

1. A lubricator for a plunger lift system for hydrocarbon production, comprising:
- a housing;
- a spring disposed in the housing for absorbing an impact by a plunger; and
- a sensor configured to measure at least one parameter of the spring, wherein the at least one parameter comprises a force of the impact by the plunger on the spring and wherein the sensor is adapted for communication with a control unit configured to output at least one signal for operating the plunger lift system based on the at least one parameter.

2. The lubricator of claim 1, wherein the at least one parameter comprises a spring preload.

3. The lubricator of claim 2, wherein the sensor comprises a load cell.

4. The lubricator of claim 1, wherein the at least one parameter comprises vibration of the spring.

5. The lubricator of claim 4, wherein the sensor comprises an accelerometer.

6. The lubricator of claim 5, wherein the accelerometer comprises a microelectromechanical systems (MEMS)-based accelerometer.

7. The lubricator of claim 1, wherein the at least one parameter comprises sound waves produced by the spring.

8. The lubricator of claim 7, wherein the sensor comprises a microelectromechanical systems (MEMS)-based microphone.

9. A method of operating a plunger lift system for hydrocarbon production, comprising:
- measuring at least one parameter of a spring disposed in a lubricator of the plunger lift system, wherein the at least one parameter comprises a force of an impact by a plunger on the spring; and
- operating the plunger lift system based on the measured parameter.

10. The method of claim 9, wherein operating the plunger lift system comprises at least one of replacing the spring or adjusting control settings of the plunger lift system based on the measured parameter.

11. The method of claim 9, wherein the at least one parameter comprises a spring preload.

12. The method of claim 11, wherein operating the plunger lift system comprises:
- determining that the spring preload is below a threshold level; and
- replacing the spring based on the determination.

13. The method of claim 9, wherein the at least one parameter comprises at least one of vibration of the spring or sound waves produced by the spring.

14. The method of claim 13, wherein operating the plunger lift system comprises:
- determining that the spring has lost compression based on the vibration; and
- replacing the spring based on the determination.

15. The method of claim 13, further comprising:
- determining a first time when a fluid interface contacts the lubricator based on the at least one parameter;

determining a second time when the plunger impacts the lubricator based on the at least one parameter; and calculating a fluid volume based on a predetermined production tubing geometry and a difference between the first and second times, wherein operating the plunger system comprises adjusting control settings of the plunger lift system based on the calculated fluid volume.

16. The method of claim 15, wherein the calculated fluid volume indicates a dry run for a cycle of the plunger lift system.

17. The method of claim 15, further comprising calculating wear of the spring based on a ratio of the calculated fluid volume to the force of the impact by the plunger.

18. The method of claim 9, further comprising outputting the measured parameter to a display.

19. A method of operating an artificial lift system for hydrocarbon production, comprising:

measuring at least one parameter associated with a spring disposed in a housing of a lubricator of the artificial lift system during at least a portion of a cycle in the artificial lift system;

determining a signature for the at least the portion of the cycle, based on the measured parameter;

comparing the signature to a plurality of predetermined signatures; and operating the artificial lift system based on the comparison.

20. The method of claim 19, wherein the artificial lift system comprises a plunger lift system.

21. The method of claim 19, further comprising determining at least one of an operating characteristic or a failure mode based on the comparison.

22. The method of claim 21, wherein the operating comprises operating the artificial lift system based on the at least one of the operating characteristic or the failure mode.

23. The method of claim 21, wherein the failure mode comprises at least one of a damaged spring, loss of spring preload, a clogged valve, or a worn spring or bearing.

24. The method of claim 21, wherein the operating characteristic comprises at least one of a dry run, a lift velocity, or a fall velocity.

25. The method of claim 19, wherein the at least one parameter comprises at least one of sound, vibration, or shock.

26. The method of claim 19, wherein the at least one parameter is measured using a microelectromechanical systems (MEMS) device.

27. The method of claim 26, wherein the MEMS device comprises an accelerometer or a microphone.

28. The method of claim 19, wherein the at least one parameter is measured by at least one sensor located at or adjacent a wellhead.

29. The method of claim 19, further comprising outputting a visual representation of the signature to a display.

30. A method of operating an artificial lift system for hydrocarbon production, comprising:

measuring at least one parameter associated with a spring disposed in a housing of a lubricator of the artificial lift system using at least one of an accelerometer or a microelectromechanical systems (MEMS)-based sensor, wherein the at least one parameter comprises a force of an impact by a plunger on the spring; and operating the artificial lift system based on the measured parameter.

31. The method of claim 30, wherein the artificial lift system comprises a plunger lift system.

32. The method of claim 30, wherein the accelerometer comprises a MEMS-based accelerometer.

33. The method of claim 30, wherein the MEMS-based sensor comprises a MEMS-based microphone.

34. The method of claim 30, wherein operating the artificial lift system comprises replacing a component in or adjusting control settings of the artificial lift system based on the measured parameter.

35. The method of claim 30, wherein the artificial lift system comprises multiple tubing joints and wherein the at least one parameter comprises a vibration or sound of a fluid or an object associated with the artificial lift system moving across interfaces between the tubing joints.

36. The method of claim 35, further comprising determining at least one of a rising velocity or a falling velocity of the fluid or the object based on the vibration or sound, wherein operating the artificial lift system comprises adjusting control settings of the artificial lift system based on the rising velocity or the falling velocity.

37. The method of claim 30, wherein the at least one parameter comprises a vibration or sound of a fluid or an object associated with the artificial lift system.

38. The method of claim 37, wherein the vibration or sound of the fluid or the object indicates wear or declining performance of a component in the artificial lift system.

39. The method of claim 37, further comprising calculating a fluid volume based on a predetermined production tubing geometry and the vibration or sound of the fluid or the object.

40. The method of claim 30, further comprising storing the measured parameter in a memory, wherein the artificial lift system is operated based on an analysis of the stored measured parameter over time.

41. A control unit for a plunger lift system for hydrocarbon production, wherein the control unit is configured to:

receive at least one measured parameter of a spring disposed in a lubricator of the plunger lift system, wherein the measured parameter comprises a force of an impact by a plunger on the spring; and output, from the control unit, at least one signal for operating the plunger lift system based on the measured parameter.

42. A control unit for an artificial lift system for hydrocarbon production, wherein the control unit is configured to:

receive at least one measured parameter associated with a spring disposed in a housing of a lubricator of the artificial lift system during at least a portion of a cycle in the artificial lift system;

determine a signature for the at least the portion of the cycle, based on the measured parameter;

compare the signature to a plurality of predetermined signatures; and output, from the control unit, at least one signal for operating the artificial lift system based on the comparison.

43. A control unit for an artificial lift system for hydrocarbon production, wherein the control unit is configured to:

receive at least one parameter associated with a spring disposed in a housing of a lubricator of the artificial lift system measured using at least one of an accelerometer or a microelectromechanical systems (MEMS)-based sensor, wherein the measured parameter comprises a force of an impact by a plunger on the spring; and output, from the control unit, a signal for operating the artificial lift system based on the measured parameter.

44. A method of operating a plunger lift system for hydrocarbon production, comprising:

measuring at least one parameter of a spring disposed in a lubricator of the plunger lift system; and operating the plunger lift system based on the measured parameter, wherein the operating comprises:

determining that the spring has lost compression based on the vibration; and replacing the spring based on the determination.

45. A method of operating a plunger lift system for hydrocarbon production, comprising:

measuring at least one parameter of a spring disposed in a lubricator of the plunger lift system;

determining a first time when a fluid interface contacts the lubricator based on the at least one parameter;

determining a second time when the plunger impacts the lubricator based on the at least one parameter;

calculating a fluid volume based on a predetermined production tubing geometry and a difference between the first and second times; and operating the plunger lift system based on the measured parameter, wherein the operating comprises adjusting control settings of the plunger lift system based on the calculated fluid volume.

46. The method of claim 45, wherein the calculated fluid volume indicates a dry run for a cycle of the plunger lift system.

47. The method of claim 45, further comprising calculating wear of the spring based on a ratio of the calculated fluid volume to the force of the impact by the plunger.

* * * * *